US005448250A

United States Patent [19]

Day

[11] Patent Number: 5,448,250

[45] Date of Patent: Sep. 5, 1995

[54] LAMINAR MICROSTRIP PATCH ANTENNA

[75] Inventor: Stephen R. Day, Greater Manchester, England

[73] Assignee: Pilkington plc, Merseyside, United Kingdom

[21] Appl. No.: 127,734

[22] Filed: Sep. 28, 1993

[30] Foreign Application Priority Data

Sep. 28, 1992 [GB] United Kingdom ..... 9220414

[51] Int. Cl.[6] ..... H01Q 1/38

[52] U.S. Cl. ..... 343/700 MS; 343/713; 343/829

[58] Field of Search ..... 343/700 MS, 713, 846, 343/848, 829, 830; H01Q 1/38

[56] References Cited

U.S. PATENT DOCUMENTS

| | | | |
|---|---|---|---|
| 4,364,050 | 12/1982 | Lopez | 343/700 MS |
| 4,761,654 | 8/1988 | Zaghloul | 343/700 MS |
| 4,843,400 | 6/1989 | Tsao et al. | 343/700 MS |
| 4,903,033 | 2/1990 | Tsao et al. | 343/700 MS |
| 5,043,738 | 8/1991 | Shapiro et al. | 343/700 MS |
| 5,241,321 | 8/1993 | Tsao | 343/700 MS |

FOREIGN PATENT DOCUMENTS

| | | | |
|---|---|---|---|
| 2685130 | 6/1993 | France . | |
| 3834075 | 4/1989 | Germany . | |
| 0217703 | 10/1985 | Japan | 343/700 MS |
| 020105704 | 2/1990 | Japan . | |
| 03254208 | 3/1991 | Japan . | |
| 2251520 | 8/1992 | United Kingdom . | |

OTHER PUBLICATIONS

Abstract of JP 020105704 and Abstract of JP 03254208.

Article: A. Adrian and D. H. Schaubert, "Dual Aperture-Coupled Microstrip Antenna For Dual Or Circular Polarisation", Electronics Newsletter, vol. 23, No. 23, 1226–1227 Nov. 5, 1987.

H. Iwasaki and K. Kawabata "A Circularly Polarized Microstrip Antenna With A Cross Slot", The 3rd Asia-Pacific Microwave Conference Proceedings, Tokyo, 1990, pp. 281–284.

*Primary Examiner*—Donald Hajec
*Assistant Examiner*—Tan Ho
*Attorney, Agent, or Firm*—Burns, Doane, Swecker & Mathis

[57] ABSTRACT

A laminar microstrip patch antenna includes a ground plane dement having opposing first and second faces, a first dielectric planar member adjacent a first face of the ground plane element, a patch radiator on a face of the first dielectric member remote from said ground element, a second dielectric planar member adjacent a second face of the ground plane element, and a transmission line circuit for feeding the antenna. The transmission line circuit is located on a face of the second dielectric member remote from said ground plane element, and the ground plane has an aperture to couple the transmission line circuit to the patch radiator. The aperture is formed as a cross made up of two intersecting linear slots. The transmission line circuit is formed by two linear conductors intersecting each other at a single electrically insulated point, the intersection point being aligned with a center of the intersection of the aperture cross with the linear conductors lying between the slots of the aperture.

16 Claims, 4 Drawing Sheets

LAMINAR MICROSTRIP PATCH ANTENNA

The invention relates to a patch antenna assembly and particularly to such an assembly suitable for use in a vehicle glazing panel.

BACKGROUND OF THE INVENTION

Aperture coupled patch antennae are known for use in receiving and transmitting high frequency signals such as microwave signals. These are particularly suitable for mobile satellite communications and are applicable to communication systems in mobile vehicles. An example of such a patch antenna is shown in U.S. Pat. No. 5,043,738. That specification illustrates an aperture coupled antenna and systems of this type are particularly applicable to use on a vehicle glazing panel as it may avoid obtrusive protrusions outside the glass surface. No electrically conducting connections are required through the glass of the glazing panel and in a preferred arrangement the patch antenna is arranged to cause only minor signal strength degradation with rain drops or water on the outside of the vehicle surface. Such systems may be used to transmit or receive plane polarised radiation or in some cases circular polarisation may be preferred. Circular polarisation is particularly suited to vehicle communication systems in that they are less sensitive to vehicle direction. Various proposals have been made for apertures and feed lines used in such coupling systems. In U.S. Pat. No. 5,043,738 there is described a system in which two separated apertures are provided in a ground plane so as to provide coupling between transmission feed circuit members and a radiating patch. To obtain circular polarisation that specification uses two laterally separated feed members having their end regions directed at right angles to each other so that each intersects the line of its respective aperture in the ground plane. However such a system requiring laterally spaced feed conductors with apertures forming separated arms of an L shaped configuration does not provide either symmetrical or strong coupling through the aperture to the radiating patch.

When used in a vehicle glazing panel it is of course necessary that the dielectric layer between the ground plane and a radiating patch will be formed of glass and this will have a thickness determined by the particular glazing requirements of the vehicle. Due to the high dielectric constant of glass and the relatively large separation between the ground plane and the radiating patch which will result from using typical thickness of toughened automotive glass, it is important to achieve an effective coupling through the aperture between the transmission feedline circuitry and the radiating patch.

It is also known to provide crossing feed members which are aligned with a cross shaped aperture but in an arrangement where the two feed members make electrical contact with each other at their cross-over point. Such a system does not provide good quality circular polarisation due to current interchange between the feed members in the region of coupling with the aperture.

It is important to use a feed system having isolated current paths in the feed system in the region of coupling through an aperture in order to achieve good quality circular polarisation of radiation from the patch.

It is an object of the present invention to provide an antenna system having improved coupling between a transmission line circuit and a radiating patch through an aperture in a ground plane, and a feed system which can generate high quality circular polarisation.

It is a further object of the invention to provide an improved antenna system suitable for use in a vehicle glazing panel.

SUMMARY OF THE INVENTION

The present invention provides a laminar microstrip patch antenna comprising a ground plane element having opposing first and second faces, a first dielectric planar member adjacent a first face of the ground plane element, a patch radiator on a face of the first dielectric member remote from said ground element, a second dielectric planar member adjacent a second face of the ground plane element, and a transmission line circuit for feeding the antenna which circuit is located on a face of the second dielectric member remote from said ground plane element, said ground plane having an aperture to couple the transmission line circuit to the patch radiator, which aperture comprises a cross formed by two linear slots intersecting each other, and said transmission line circuit comprising two linear conductors intersecting each other so that one extends across the other but electrically insulated from each other at the point of intersection, the intersection of said linear conductors being aligned with the centre of the aperture cross with the directions of the linear conductors lying between the slots of the aperture.

Preferably each linear conductor has an open circuit projection beyond a slot of said aperture providing an effective short circuit to said ground plane element, the insulation between said linear conductors thereby resulting in isolated current paths in said linear conductors each of which current paths crosses the aperture and leads only to the projection of the respective linear conductor in one quadrant of said cross.

Preferably said projection is a quarter wave length projection.

Preferably the aperture is formed of two equal length slots intersecting each other at their mid points.

Preferably the slots extend orthogonally relative to each other.

Preferably the direction of each linear conductor is arranged to lie centrally between a pair of slots in the aperture so as to form symmetrical alignment between the intersecting conductors and the aperture cross.

Preferably the linear conductors extend at right angles to each other.

The linear conductors may each have a reduced width in the region of their intersection.

Preferably each of the linear conductors has a tapered change in width on one side of the point of intersection, thereby forming a flared section having an angle of taper matching an aligned space between slots in said aperture.

Preferably each linear conductor has an open circuit projection beyond the point of intersection of the two conductors.

Preferably said projection is outwardly flared with an angle of taper matching an aligned space between slots in said aperture.

The invention is particularly suited to a vehicle glazing panel when the first dielectric planar member comprises a glass sheet forming part of the glazing panel.

The second dielectric planar member may be in the form of a panel smaller than the glazing panel and adhered to the glazing panel after formation of the glazing panel. Alternatively the second dielectric planar member may comprise a glass sheet of a laminated glazing panel.

The invention provides an antenna system as aforesaid in which the transmission feed circuitry is coupled to one or more coaxial cables, the earth sheath of each cable being connected to an earthing connection on said second dielectric planar member and arranged to form a short circuit connection to the ground plane without any physical conducting member extending through the second dielectric planar member.

The invention includes a vehicle glazing panel having an antenna system as aforesaid.

Figure 1:
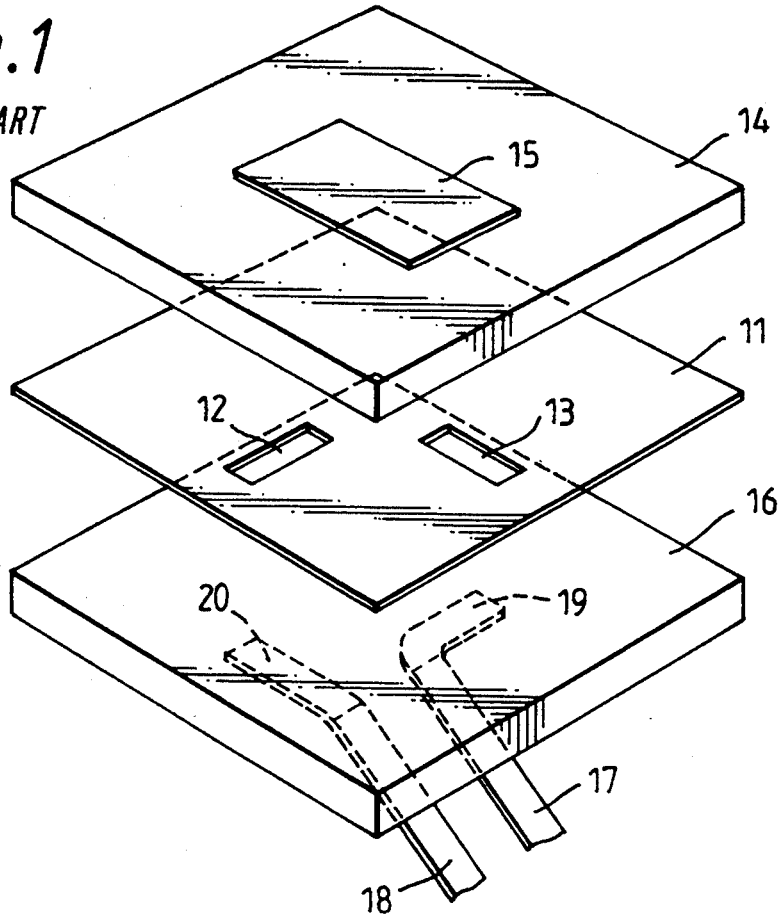
Fig. 1 PRIOR ART
FIG. 1 is an exploded view of a laminar antenna assembly of the prior art.

The prior art arrangement shown in FIG. 1 is generally similar to that shown in U.S. Pat. No. 5,043,738. In that arrangement a conducting ground plane 11 is provided with two orthogonal apertures 12 and 13 spaced physically apart and forming two spaced arms of an L shaped configuration. Above the ground plane 11 is a dielectric sheet 14 on the upper surface of which is mounted a rectangular conducting patch 15 which acts as an electromagnetic radiator device. Below the ground plane 11 is a further dielectric sheet 16 carrying on its lower face feed conductors 17 and 18 for providing or receiving signals passed through the patch 15. In this example the feed conductors 17 and 18 do not make electrical contact with each other so that they provide separate current paths. The ends 19 and 20 of the conductors 17 and 18 are bent so as to extend perpendicular to each other and intersect at right angles the respective slots 13 and 12 in the ground plane 11. As it is necessary to physically separate the slots 12 and 13 as well as the conductor ends 19 and 20 it is not possible to arrange the slots centrally below the patch 15 where the strongest coupling occurs. It will be understood that when assembled the three planar elements 11, 14 and 16 in FIG. 1 are held together as a sandwich so as to form a laminar assembly.

DESCRIPTION OF THE PREFERRED EMBODIMENTS

Figure 2:
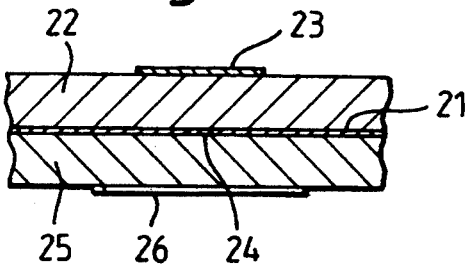
FIG. 2 is a section through a laminar antenna in accordance with the present invention.

The embodiments of the present invention each comprise a laminar assembly of the type shown in FIG. 2. The laminar assembly has a ground plane 21 formed of a conducting material which in this example is formed on the lower face of a glass sheet 22 providing a first dielectric layer. On top of the glass sheet 22 is printed a conducting patch radiator 23. Symmetrically located below the centre of the patch 23 is an aperture 24 in the ground plane 21 which will be described below. Beneath the ground plane 21 is a second dielectric layer 25 which in this case comprises a further dielectric sheet and on the lower face of this dielectric sheet is formed a transmission line circuit 26. As can be seen from the underside view of FIG. 3, the aperture 24 formed in the ground plane 21 comprises two elongated slots intersecting each other to form a symmetrical cross in which the arms of the cross all have equal length and the two intersecting slots cross each other at right angles. The transmission line circuit 26 includes two orthogonal conducting strips 27 and 28 arranged to extend one across the other thereby forming a cross coincident with the centre of the aperture cross 24. In this case the strips 27 and 28 are symmetrically arranged relative to the cross so as to bisect the angles between the elongated slots of the cross. The circuit also includes two ground coupling elements 30 and 31 which are each semicircular in shape and printed on the lower face of the glass sheet 25. In use the earth braids of coaxial cables will be connected to the conducting coupling elements 30 and 31 and the central wires of coaxial cables will be connected to ends of the conducting strips 27 and 28 so as to deliver signals with a phase difference such as to produce circular polarisation of the transmitted signals. The two conducting strips 27 and 28 are electrically insulated at the point where they intersect by means of a bridge element. The bridge element 33 in FIG. 4 is a common surface mount conducting component which is in electrical contact with the conducting strip 27 but is separated from conducting strip 28 by an insulator 34. This provides separate current paths for the two strips 27 and 28 in the region of coupling through the aperture 24.

Figure 3:
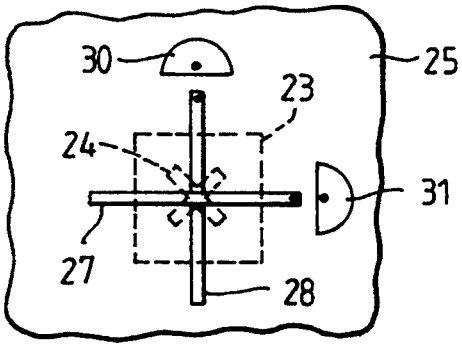
FIG. 3 is an underside view of part of the antenna assembly of FIG. 2.
Figure 4:
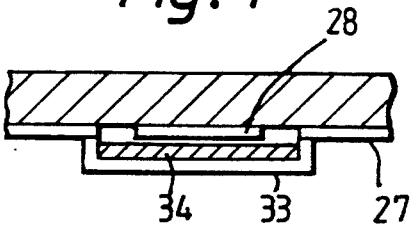
FIG. 4 shows an enlarged view in section of an intersection of two linear conductors in the antenna assembly of FIGS. 2 and 3.

In the particular example illustrated in FIG. 3 each of the conducting strips 27 and 28 is arranged to be of constant and uniform width. They each project beyond the aperture 24 in a direction away from the respective earth connection 30 or 31 by a distance equal to one quarter wavelength of the radiation to be transmitted or received along the transmission line. This provides a quarter wavelength open circuit thereby acting as a short circuit between that conducting strip and the ground plane below the projecting end of the conducting strip. The passage over the aperture 24 in each of the conducting strips preferably provides a 50 ohm resistance as will later be described with reference to FIG. 9. By insulating the strips 27 and 28 at their crossover and because each strip 27, 28 has an effective connection to the ground plane 21 only at a position below its own end, each strip 27, 28 forms part of an isolated current path across the aperture 24 leading to a single quadrant of the cross shaped aperture. This results in high quality circular polarisation which would not result if the strips 27 and 28 made electrical contact with each other.

Figure 5:
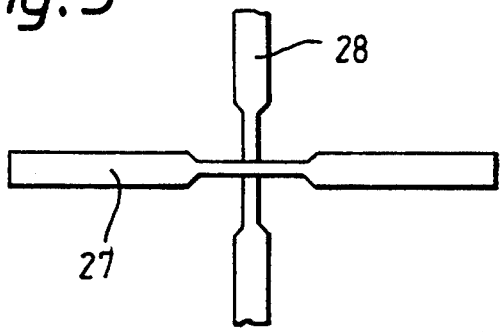
FIG. 5 is a schematic view of an alternative arrangement of two intersecting conductors for use with an assembly of the type shown in FIG. 3.

FIG. 5 shows an alternative arrangement to FIG. 3 in which the conducting strips 27 and 28 have a reduced width in their central regions where they pass over the aperture 24. This reduces the capacitive coupling between the two transmission lines in that region. The strips 27 and 28 are still insulated from each other at their cross-over.

Figure 6:
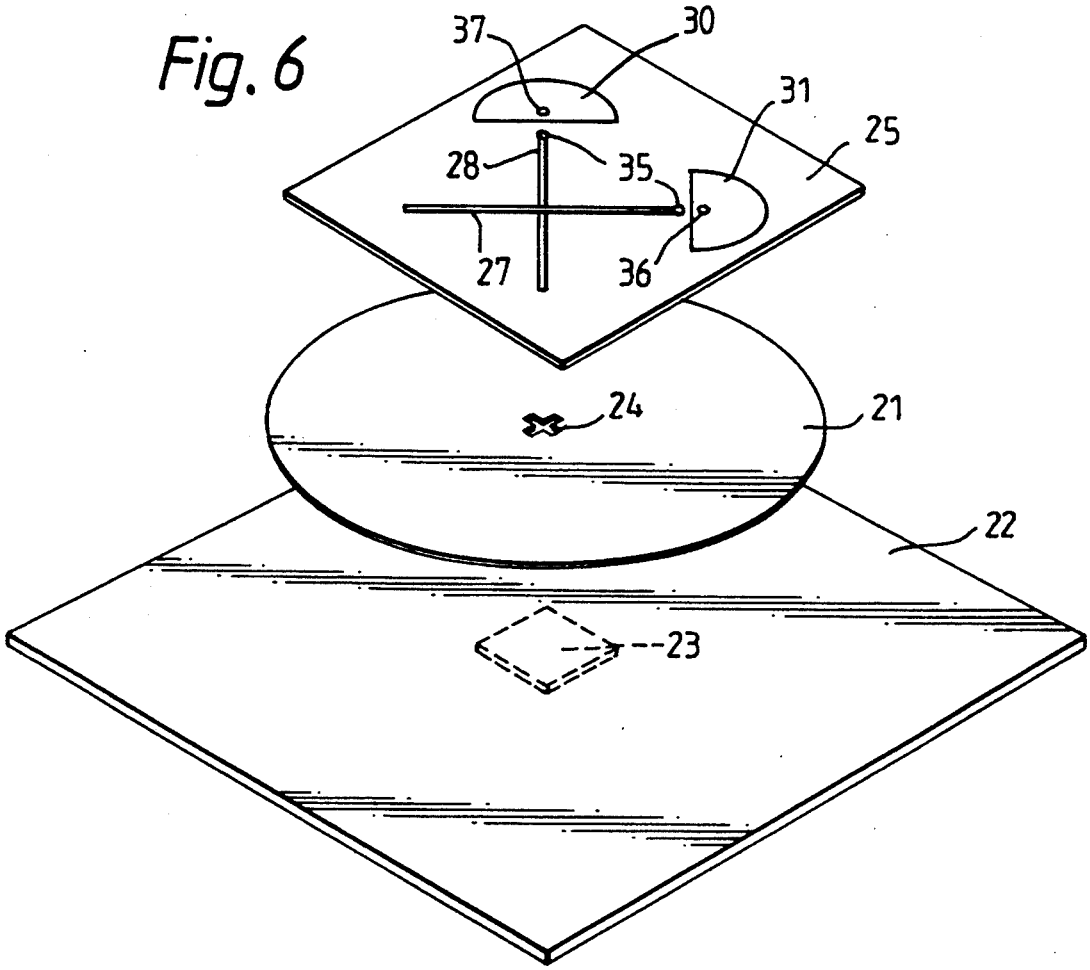
FIG. 6 is an exploded perspective view showing the arrangement of the antenna assembly used in FIGS. 2, 3 and 4.

FIG. 6 shows more clearly the overall antenna assembly previously described in FIG. 2, 3 and 4. In this arrangement the intersection point of the conducting strips 27 and 28 is aligned with the centre of the aperture 24 and with the centre of the patch radiator 23. In this example the ground plane 21 is in the form of a circular conducting region having an area substantially greater than the area of the patch 23. The area of the ground plane is also sufficient to extend outside the area covered by the conducting regions of the transmission line circuit 26. In use, the central conductors of coaxial cables will be connected to the terminals marked 35 on the conducting strips 27 and 28. The earth braid of coaxial cables will be connected to terminals marked 36 and 37 on the semicircular conducting pads 30 and 31.

By use of the arrangement shown in FIGS. 2 to 6 it is possible to arrange for symmetry of the coupling provided by the aperture between the transmission line circuitry and the radiating patch. This gives improved circular polarisation purity and improves the coupling through the aperture as well as improving the space available to implement feed line width modifications in the region of the aperture.

It is known that an open circuited quarter wavelength transmission line spaced from the ground plane by a dielectric material provides an effective short circuit connection between the conductor and the ground plane. Such quarter wavelength sections of conductor can be replaced by a fan shaped transmission line with similar properties but broader band width. When extended to a semicircular transmission line this can be used for forming the earth connections as shown by the semicircular conducting regions 30 and 31.

Figure 7:
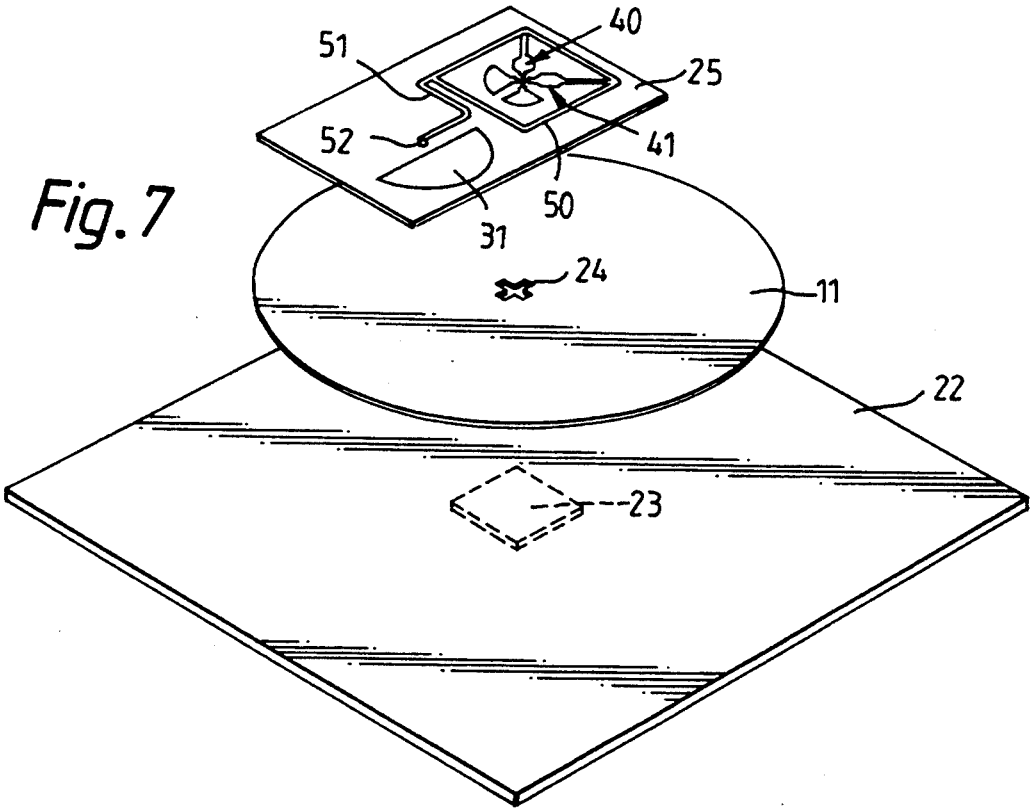
FIG. 7 is an exploded perspective view similar to FIG. 6 of an alternative embodiment of the present invention.

FIG. 7 is generally similar to the exploded view of FIG. 6 although showing the modified form of transmission line circuit on the dielectric sheet 25. The ground plane 11 and glass sheet 22 are the same as previously described. In this example the linear conducting strips 27 and 28 have been replaced by conducting strips 40 and 41 as shown in both FIGS. 7 and 8. The conductors 40 and 41 are arranged on the axis of the linear strips 42 and 43 respectively which extend perpendicular to each other and are arranged to intersect the cross aperture 24 in a symmetrical manner exactly as previously described for the conductors 27 and 28 in FIG. 3. However in this case the conductor 40 comprises an enlarged region 44 before reaching the aperture 24 and an enlarged quarter circular fan shaped projection 45 on the far side of the aperture 24. Conductor 41 similarly has an enlarged region 46 before reaching the aperture 24 and an enlarged quarter circular fan shaped conductor 47 projecting beyond the aperture 24. The conductors 40 and 41 are connected to opposite corners of a rectangular conducting branch line coupler circuit 50 connected by a linear conducting strip 51 to a terminal 52 for connection to the central core of a coaxial cable. Such a coupler circuit 50 feeding two transmission lines in a quadrature arrangement is already known for achieving circular polarisation. However the shape and arrangement of the conductors 40 and 41 in relation to the aperture 24 have not previously been known. The two conducting strips 40 and 41 are electrically insulated from each other by a bridging arrangement at the point of intersection similar to that already described in FIG. 4. In this case the enlarged projections of the conductors 40 and 41 before reaching the aperture and the flared projections after the aperture 24 each provide tapered regions adapted to fit symmetrically in alignment with the spaces between the slots forming the aperture 24. This allows effective symmetrical coupling between the conducting elements of the feed circuit and the aperture providing the coupling to the patch. This results in achieving low impedances in a more compact space than with the quarter wavelength projections used in FIG. 3. In the example of FIG. 7 a semicircular conducting region 31 is provided similar to that of FIGS. 3 and 6. In this case the semicircular region 31 will be connected to the earth braid of a coaxial cable.

Figure 8:
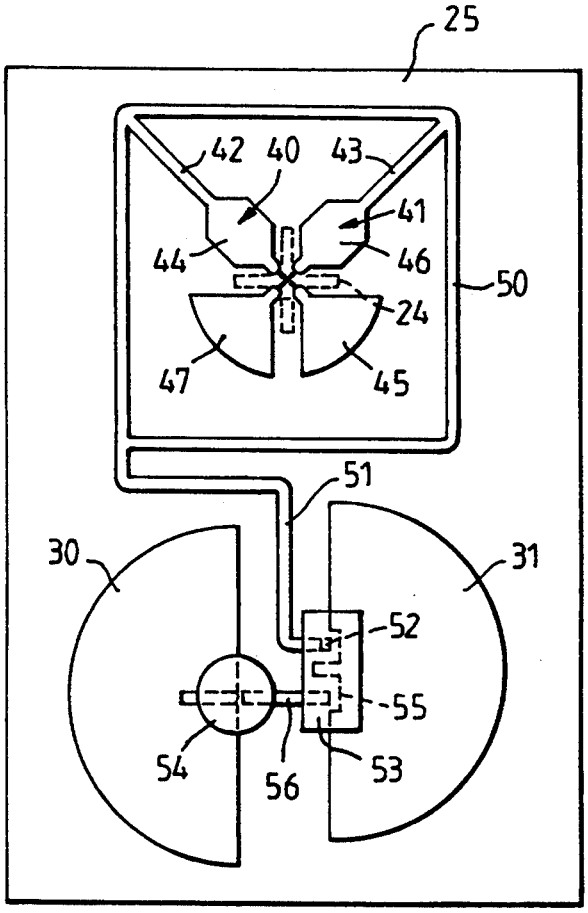
FIG. 8 is a plan view of a transmission line circuit used in a modified form of FIG. 7, FIGS. 9 and 10 are explanatory diagrams of the resistance caused by ideal aperture coupling in the example of FIG. 3, and FIGS. 11 and 12 are circuit diagrams illustrating the impedance provided by the aperture coupling in the arrangement of FIG. 8.

In FIG. 8 a dielectric sheet 25 is shown similar to that of FIG. 7. However, in FIG. 8 the provision of a filter element 53 and an amplifier 54 is shown. In this arrangement the filter element 53 is connected between the linear conducting strip 51, the terminal 55 on the coupling element 31 and a separate conducting connecting strip 56. The conducting connecting strip 56 is also connected, in turn, to one terminal of the amplifier 54. Two further terminals of the amplifier 54 are connected to a semicircular coupling element 30 which acts as a ground and the final, fourth terminal of the amplifier 54 is used as the output terminal.

Figure 9:
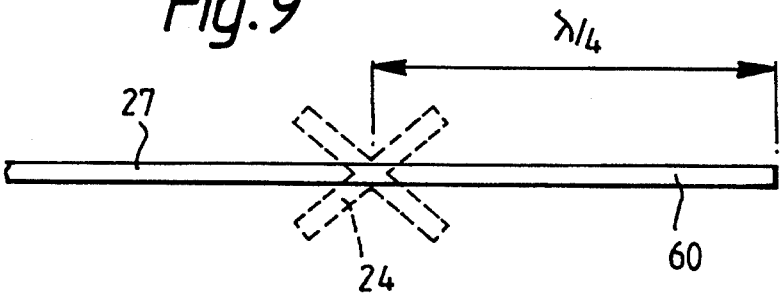
Figure 10:
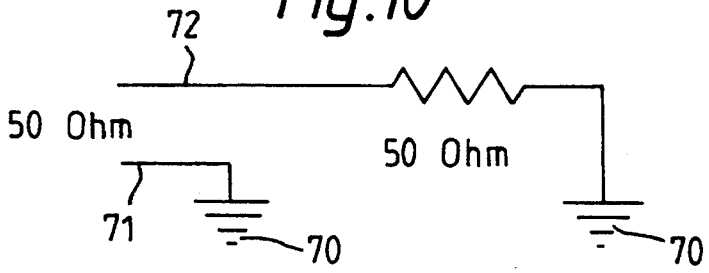

To provide good coupling between the feed circuit and the patch it is desirable that the aperture has the effect of providing a 50 ohm impedance in the transmission line at the point where the feed line crosses the aperture. This will now be described more fully with reference to FIGS. 9 and 10. FIG. 9 illustrates the conducting strip 27 extending over the aperture 24 with a quarter wavelength projection 60 at the free end of the conducting strip. The circuit equivalent of this is shown in FIG. 10 where the earth 70 is provided by the ground plane 21 and lead 71 indicates the connection from the earth braid of a coaxial cable which provides a connection to the ground plane through the conducting region 30 or 31 and its effective short circuit to the ground plane. Line 72 indicates the conducting path from the central line of a coaxial cable through the transmission line 27 and where this passes over the aperture 24 it has the effect of providing a 50 ohm series resistance. The projection 60 of the transmission line forms a short circuit connection to the ground plane thereby completing the circuit as shown in FIG. 10.

Figure 11:
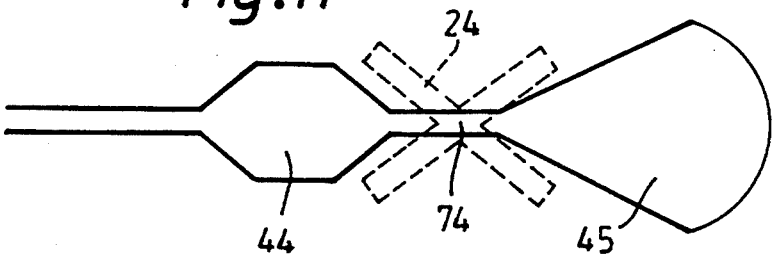
Figure 12:
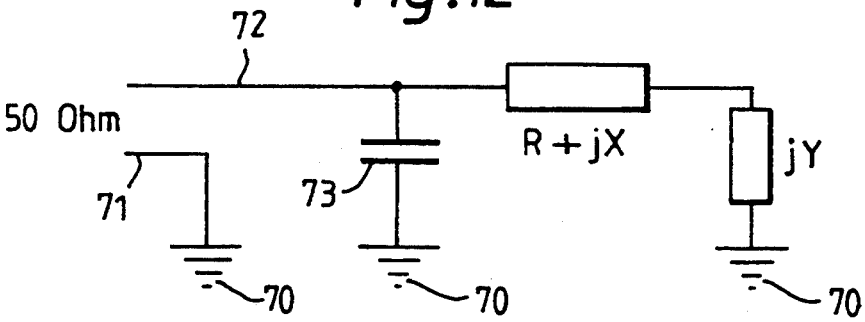

In practice poorer coupling through thick glass in a vehicle window can result in coupling through the aperture which is equivalent to an inductance in series with the resistance of less than 50 ohms and a figure of 10 or 15 ohms is typical when using toughened glass. This resistance can be transformed so as to behave more closely like the ideal 50 ohms resistance by use of the flared shapes 44 and 45 previously described. This is illustrated in FIGS. 11 and 12. Again the earth 70 is in each case provided by the ground plane 21. The line 71 is as previously described in FIG. 10. However in this case line 72 which represents the signal path through the transmission line has a capacitive coupling 73 provided by the enlarged region 44. The thin part of the conductor 74 extending over the aperture 24 provides the effect of a series resistance R plus a complex impedance jX.

The projecting region 45 beyond the aperture 24 provides coupling to the earth 70 but itself induces a capacitive or inductive effect shown by the complex impedance jY in FIG. 12. By varying the shape of the enlarged regions 44 and 45 it is possible to vary the capacitive and inductive impedance induced in the circuit. This results in an LC resonant circuit and the Q factor of that circuit will control the resistance multiplication so as to obtain an effect equal to the desired 50 ohms to achieve maximum coupling through the aperture.

When the antenna is constructed in a laminated glass assembly with reduced glass spacing between the patch 23 and the ground plane 21 a coupling resulting in a 50 ohm resistance is more easily obtained. It may still be preferable to use a smaller aperture 24 together with shaped conductors of the type illustrated in FIGS. 7 and 8 in order to achieve a more compact circuit.

The above examples can be formed on glass or other transparent material either in single sheet or laminate form. The invention may also be used on non-transparent dielectric surfaces. The operating frequency suitable for satellite communication antennae in accordance with this example are preferably between 0.5 and 10 GHz and more preferably in the L-band typically operating at 1.575 GHz. The examples may be used for global positioning systems for a vehicle, including cars and boats.

The patch 23 may be printed with conductive inks or frits or etched from a conductive coating or may be created from an adhered metal foil or plate or polymer film carrying a conductive foil or coating. The patch may be protected from corrosion and abrasion and/or its appearance enhanced by a protective coating of glass frit, paint or self-adhesive polymer film. The patch may be protected from corrosion or effects of the environment with a hollow or solid dielectric radome and the patch may be attached to either the glazing or the radome.

A cover or encapsulation may be provided to protect the circuit components.

The ground plane 11 may be circular as shown or may be of other selected shapes. The shape and size of the patch 23 may be selected to suit the frequency of radiation to be transmitted or received by the antenna. The ground plane 11 may be perforated at its periphery to cause it to fade into its surroundings on the glass sheet. Small electrically conductive spots may surround the ground plane which have only a marginal effect on the ground plane but help it fade into its surroundings. The ground plane may be printed with conducting inks or frits or etched from a conductive coating or created from an adhered metal foil or from a film carrying a metal foil or coating. The antenna may be used in a system using known methods of diversity or beam steering having a plurality of antenna elements as previously described and these may use a common or individual ground planes.

In some applications it may be desirable to make shape modifications to the four arms of the cross aperture 24 so as to alter the degree of band width of the coupling.

In some examples additional patches may be stacked above or placed to the side of the driven patch so as to modify the radiation pattern or create multiple resonant frequencies or improve antenna band width.

The symmetry of the cross or patch 23 may be varied from that previously described in order to obtain elliptical rather than circular polarisation. The polarisation may be modified by changing the phase and amplitude relations of signals on the two orthogonal feeds or combination ratios of the receive signals on the two feeds.

The above embodiments may be mounted on the roof light of a motor vehicle to obtain mobile satellite communications.

The invention is not limited to the details of the foregoing examples.

I claim:

1. A laminar microstrip patch antenna comprising:

a ground plane element having opposing first and second faces;

a first dielectric planar member adjacent the first face of the ground plane element;

a patch radiator on a face of the first dielectric member remote from said ground element;

a second dielectric planar member adjacent the second face of the ground plane element; and a transmission line circuit for feeding the antenna, which circuit is located on a face of the second dielectric member remote from said ground plane element, said ground plane having an aperture to couple the transmission line circuit to the patch radiator, which aperture comprises a cross formed by two linear slots intersecting each other, and said transmission line circuit comprising two linear conductors positioned to intersect at a point and means to electrically insulate the linear conductors from each other at the point of intersection, the electrically insulated intersection point of said linear conductors being aligned with a center of the intersection of the aperture cross with the linear conductors lying between the slots of the aperture.

2. An antenna according to claim 1 in which each linear conductor has an open circuit projection beyond a slot of said aperture providing an effective short circuit to said ground plane element, the insulation between said linear conductors thereby resulting in isolated current paths in said linear conductors each of which crosses the aperture and leads only to the projection of the respective linear conductor in one quadrant of said cross.

3. An antenna according to claim 2 in which said projection is a quarter wavelength projection.

4. An antenna according to claim 2 in which said projection is outwardly flared with an angle of taper matching an aligned space between slots in said aperture.

5. An antenna as claimed in claim 1, in which the aperture is formed of two equal length slots intersecting each other at their mid points.

6. An antenna according to claim 1, in which the slots extend orthogonally relative to each other.

7. An antenna according to claim 1, in which the direction of each linear conductor is arranged to lie centrally between said pair of slots in the aperture so as to form symmetrical alignment between the intersecting conductors and the aperture cross.

8. An antenna according to claim 1, in which the linear conductors extend at right angles to each other.

9. An antenna according to claim 1, in which the linear conductors each have a reduced width in the region of their intersection.

10. An antenna according to claim 9, in which each of the linear conductors has a tapered change in width on one side of the point of intersection, thereby forming a flared section having an angle of taper matching an aligned space between slots in said aperture.

11. An antenna according to claim 1, in which said first dielectric planar member comprises a glass sheet forming part of a vehicle glazing panel.

12. An antenna according to claim 11, in which said second dielectric planar member comprises a sheet member of smaller size than said first dielectric planar member and is adhered thereto after formation of the glazing panel.

13. An antenna according to claim 1, in which said second dielectric planar member comprises a glass sheet member.

14. An antenna according to claim 1, in which said second dielectric planar member is provided with one or more earth connections in the form of a conducting semi circular region. arranged to form a short circuit connection to said ground plane.

15. An antenna according to claim 1, in which said second dielectric member includes amplifier and filter components.

16. A vehicle glazing panel comprising a glass sheet having mounted thereon an antenna system claim 1.

* * * * *